US011009295B2

(12) United States Patent
Fukada et al.

(10) Patent No.: US 11,009,295 B2
(45) Date of Patent: May 18, 2021

(54) EXTRUDED ALUMINUM FLAT MULTI-HOLE TUBE AND HEAT EXCHANGER

(71) Applicants: UACJ Corporation, Tokyo (JP); UACJ Extrusion Corporation, Tokyo (JP)

(72) Inventors: Sayo Fukada, Tokyo (JP); Mamoru Houfuku, Tokyo (JP)

(73) Assignee: UACJ Corporation, Tokyo (JP)

( * ) Notice: Subject to any disclaimer, the term of this patent is extended or adjusted under 35 U.S.C. 154(b) by 261 days.

(21) Appl. No.: 15/770,883

(22) PCT Filed: Oct. 28, 2016

(86) PCT No.: PCT/JP2016/082021
§ 371 (c)(1),
(2) Date: Apr. 25, 2018

(87) PCT Pub. No.: WO2017/073715
PCT Pub. Date: May 4, 2017

(65) Prior Publication Data

US 2018/0313610 A1 Nov. 1, 2018

(30) Foreign Application Priority Data

Oct. 29, 2015 (JP) ..... JP2015-213131

(51) Int. Cl.
*F28D 1/053* (2006.01)
*F28F 1/02* (2006.01)
*F28F 21/08* (2006.01)

(52) U.S. Cl.
CPC ..... *F28D 1/053* (2013.01); *F28D 1/05366* (2013.01); *F28F 1/02* (2013.01);
(Continued)

(58) Field of Classification Search
CPC .. F28D 1/053; F28D 1/05366; F28D 1/05383; F28F 1/02; F28F 1/022;
(Continued)

(56) References Cited

U.S. PATENT DOCUMENTS 3,486,489 A * 12/1969 Huggins ..... F28D 1/0535 123/41.33
4,497,363 A * 2/1985 Heronemus ..... F28G 1/02 165/95
(Continued)

FOREIGN PATENT DOCUMENTS

CN 1160845 A 10/1997
JP 6-185885 A 7/1994
(Continued)

OTHER PUBLICATIONS

Machine Translation JPH06185885A (Year: 1994).*
(Continued)

*Primary Examiner* — Len Tran
*Assistant Examiner* — Gustavo A Hincapie Serna
(74) *Attorney, Agent, or Firm* — Westerman, Hattori, Daniels & Adrian, LLP

(57) ABSTRACT

An extruded aluminum flat multi-hole tube manufactured by extrusion molding includes therein a plurality of refrigerant passages extending in a tube length direction and including an upper wall surface and a lower wall surface opposed to each other and a pair of opposed sidewall surfaces. A ridge extending in the tube length direction is formed only on the upper wall surface of the refrigerant passage. The height of the ridge is 5 to 25% of the vertical width of the refrigerant passage. The ratio of the horizontal width at ½ the height of the ridge with respect to the horizontal width of the refrigerant passage is 0.05 to 0.30. The ratio of the horizontal width per inter-ridge flat portion of the upper wall surface
(Continued)

with respect to the horizontal width of the refrigerant passage is 0.20 or less.

15 Claims, 4 Drawing Sheets

(52) U.S. Cl.
CPC ..... *F28F 1/022* (2013.01); *F28F 21/084* (2013.01); *F28F 2255/16* (2013.01)

(58) Field of Classification Search
CPC ..... F28F 13/00; F28F 13/18; F28F 21/084; F28F 2255/00
USPC ..... 165/174; 126/655, 657, 658, 660, 670, 126/675
See application file for complete search history.

(56) References Cited

U.S. PATENT DOCUMENTS 5,465,782 A * 11/1995 Sun ..... F28D 15/0233 165/104.26
5,476,141 A * 12/1995 Tanaka ..... F28D 1/05391 165/173
5,784,776 A * 7/1998 Saito ..... B21B 1/227 29/727
6,854,512 B2 * 2/2005 Lee ..... F28D 1/05383 165/140
7,749,609 B2 * 7/2010 Kaimura ..... B21C 37/14 165/177
7,908,126 B2 * 3/2011 Bahel ..... G06F 30/20 703/6
8,234,881 B2 * 8/2012 Yanik ..... F25B 39/00 62/515
2001/0004935 A1 * 6/2001 Sanada ..... F25B 39/04 165/110
2004/0069477 A1 * 4/2004 Nishikawa ..... F28D 1/0391 165/175
2007/0277964 A1 * 12/2007 Higashiyama ..... F25B 39/022 165/153
2008/0185130 A1 * 8/2008 Fang ..... F28D 1/05383 165/140
2008/0223560 A1 * 9/2008 Hoenisch ..... F28F 1/022 165/145
2008/0245518 A1 * 10/2008 Kaimura ..... F28D 1/0391 165/177
2009/0065183 A1 * 3/2009 Uneno ..... F28F 3/048 165/152
2009/0314475 A1 * 12/2009 Jeon ..... F28D 1/0391 165/109.1
2012/0145358 A1 * 6/2012 Moon ..... F28D 15/046 165/104.26

FOREIGN PATENT DOCUMENTS

JP H06185885 A * 7/1994 ..... F28F 3/04
JP 8-178568 A 7/1996
JP H08178568 A * 7/1996 ..... F28F 3/04
JP 9-182928 A 7/1997
JP 2000-329487 11/2000
JP 2002318086 A * 10/2002 ..... F28F 1/022
JP 2007-322007 A 12/2007
JP 2009-63228 A 3/2009
JP 2010-112671 5/2010
JP 2010-255864 A 11/2010
JP 2012-154495 A 8/2012
JP 2014-1868 1/2014

OTHER PUBLICATIONS

Machine Translation JPH08178568A (Year: 1996).*
International Search Report dated Jan. 24, 2017, issued in counterpart application No. PCT/JP2016/082021, w/English translation. (4 pages).
Office Action dated May 13, 2019, issued in counterpart CN application No. 201680063807.7, with English translation. (18 pages).
Extended (supplementary) European Search Report dated May 16, 2019, issued in counterpart EP Application No. 16859943.9. (6 pages).

* cited by examiner

EXTRUDED ALUMINUM FLAT MULTI-HOLE TUBE AND HEAT EXCHANGER

TECHNICAL FIELD

The present invention relates to an extruded aluminum flat multi-hole tube constituting a heat exchanger such as an evaporator, a condenser or the like for use in an air conditioner such as a room air conditioner and an automotive air conditioner configured to allow air to flow through inside a fluid passage of the flat multi-hole tube in the horizontal direction, and a heat exchanger using the same.

BACKGROUND ART

There has been often used an all-aluminum heat exchanger as a heat exchanger such as an evaporator, a condenser or the like for use in an air conditioner such as a room air conditioner and a refrigerator. Such an all-aluminum heat exchanger is configured such that a large number of extruded aluminum flat multi-hole tubes are arranged in rows, inserted into and fixed to a pair of headers made of aluminum and a large number of heat dissipating fins made of aluminum are fixed to the large number of flat multi-hole tubes.

For the purpose of increasing the heat transfer performance of the heat exchanger for dedicated cooling and air conditioning, such an extruded aluminum flat multi-hole tube has conventionally been configured such that a ridge is formed in the refrigerant passages extending in the tube length direction to increase a heat transfer area inside the tube.

For example, the fluid passage in the flat tube disclosed in Patent Literature 1 includes therein a groove edge portion formed into a curved surface, a groove bottom portion formed into a curved surface, and a linear portion formed between the groove bottom portion and the groove edge portion.

In addition, the flat tube disclosed in Patent Literature 2 is a flat heat exchange tube having a plurality of fluid passages through which a first fluid flows. The wall surface of each fluid passage includes at least one ridge formed extending along the flowing direction of the fluid passage and the wall surface on which the base end of the ridge is located includes a groove extending along the ridge.

Further, in the flat tube disclosed in Patent Literature 3, a plurality of fluid passages extending in the tube length direction are formed side by side in the tube width direction with a partition wall therebetween. One projection extending in the length direction of the fluid passage is formed on an inner surface of a portion facing each fluid passage excluding the fluid passage at both ends in the tube width direction of both flat walls, and one projection extending in the length direction of the fluid passage is formed on both side surfaces of the partition wall. The height of the projection formed on the partition wall is lower than the height of the projection formed on the portion facing each fluid passage excluding the fluid passage at both ends in the tube width direction of both flat walls.

CITATION LIST

Patent Literature

[Patent Literature 1] Japanese Patent Laid-Open No. 2012-154495

[Patent Literature 2] Japanese Patent Laid-Open No. 2007-322007

[Patent Literature 3] Japanese Patent Laid-Open No. 2010-255864

SUMMARY OF INVENTION

Technical Problem

However, a heat exchanger for cooling, heating, and air conditioning wherein a ridge extending in the tube length direction is formed on a wall surface of a refrigerant passage in the tube like the flat tube disclosed in Patent Literatures 1 to 3 involves a problem that the ridge produces flow resistance, thereby causing an increase in pressure drop and a reduction in evaporation performance.

Accordingly, an object of the present invention is to provide an extruded aluminum flat multi-hole tube suppressing an increase in flow resistance due to the ridge and having high heat-transfer performance.

Solution to Problem

The present inventors have found that the problem can be solved by the following present invention.

More specifically, an aspect (1) of the present invention provides an extruded aluminum flat multi-hole tube that is a flat multi-hole tube made of aluminum or aluminum alloy and manufactured by extrusion molding, wherein the flat multi-hole tube comprises therein a plurality of refrigerant passages extending in a tube length direction and including an upper wall surface and a lower wall surface opposed to each other and a pair of opposed sidewall surfaces, a ridge extending in the tube length direction is formed only on the upper wall surface of the refrigerant passage, a height of the ridge is 5 to 25% of a vertical width of the refrigerant passage, a ratio of a horizontal width at ½ the height of the ridge with respect to the horizontal width of the refrigerant passage is 0.05 to 0.30, and the ratio of the horizontal width per inter-ridge flat portion of the upper wall surface with respect to the horizontal width of the refrigerant passage is 0.20 or less.

Further, an aspect (2) of the present invention provides an extruded aluminum flat multi-hole tube that is a flat multi-hole tube made of aluminum or aluminum alloy and manufactured by extrusion molding, wherein the flat multi-hole tube comprises therein a plurality of refrigerant passages extending in a tube length direction and including an upper wall surface and a lower wall surface opposed to each other and a pair of opposed sidewall surfaces, a ridge extending in the tube length direction is formed only on the lower wall surface of the refrigerant passage, a height of the ridge is 5 to 25% of a vertical width of the refrigerant passage, a ratio of a horizontal width at ½ the height of the ridge with respect to the horizontal width of the refrigerant passage is 0.05 to 0.30, and the ratio of the horizontal width per inter-ridge flat portion on the lower wall surface with respect to the horizontal width of the refrigerant passage is 0.20 or less.

Furthermore, an aspect (3) of the present invention provides an extruded aluminum flat multi-hole tube that is a flat multi-hole tube made of aluminum or aluminum alloy and manufactured by extrusion molding, wherein the flat multi-hole tube comprises therein a plurality of refrigerant passages extending in a tube length direction and including an upper wall surface and a lower wall surface opposed to each other and a pair of opposed sidewall surfaces, a plurality of the refrigerant passages are a combination of an upper wall surface ridge forming refrigerant passage having a ridge extending in the tube length direction formed only on the upper wall surface and a lower wall surface ridge forming refrigerant passage having a ridge extending in the tube length direction formed only on the lower wall surface, a height of the ridge is 5 to 25% of the vertical width of the refrigerant passage, a ratio of a horizontal width at ½ the height of the ridge with respect to the horizontal width of the refrigerant passage is 0.05 to 0.30, and the ratio of the horizontal width per inter-ridge flat portion of the upper wall surface with respect to the horizontal width of the refrigerant passage is 0.20 or less, and the ratio of the horizontal width per inter-ridge flat portion on the lower wall surface with respect to the horizontal width of the refrigerant passage is 0.20 or less.

Furthermore, an aspect (4) of the present invention provides a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the aspect (1).

Furthermore, an aspect (5) of the present invention provides a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the aspect (2).

Furthermore, an aspect (6) of the present invention provides a heat exchanger comprising a plurality of flat multi-hole tubes arranged in rows and a plurality of heat dissipating fins fixed to the flat multi-hole tubes, wherein a plurality of the flat multi-hole tubes are a combination of the extruded aluminum flat multi-hole tubes according to the aspect (1) and the extruded aluminum flat multi-hole tubes according to the aspect (2), and the extruded aluminum flat multi-hole tubes according to the aspect (1) are arranged on a gas phase side and the extruded aluminum flat multi-hole tubes according to the aspect (2) are arranged on a liquid phase side.

Furthermore, an aspect (7) of the present invention provides a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the aspect (3).

Advantageous Effects of Invention

The present invention can provide an extruded aluminum flat multi-hole tube suppressing an increase in flow resistance due to the ridge and having high heat-transfer performance.

DESCRIPTION OF EMBODIMENTS

Figure 1:
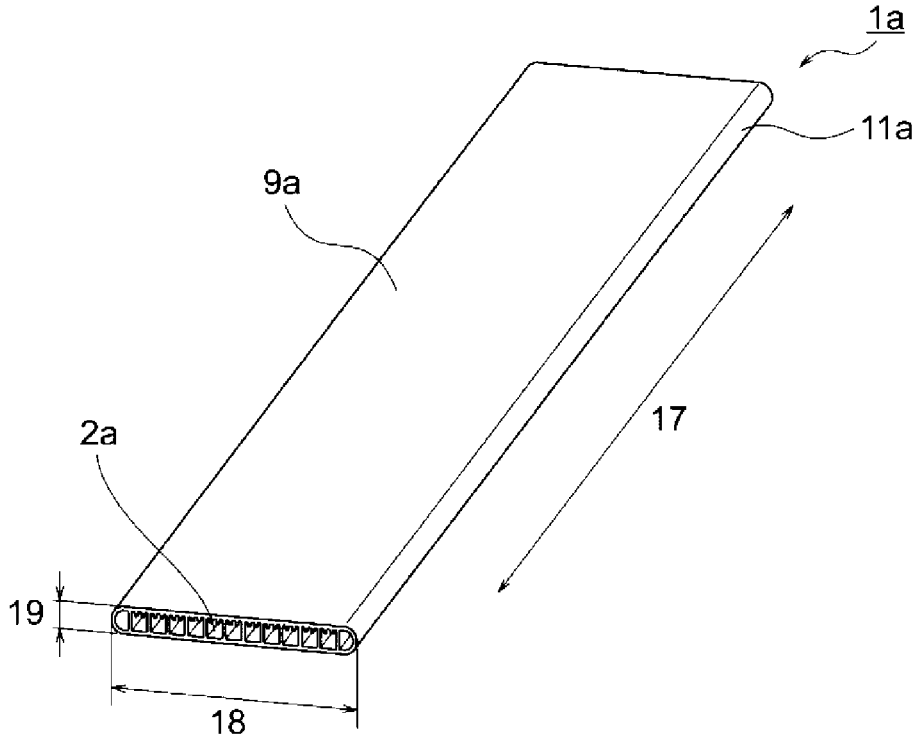
FIG. 1 is a schematic perspective view of an example of an extruded aluminum flat multi-hole tube according to a first embodiment of the present invention.
Figure 2:
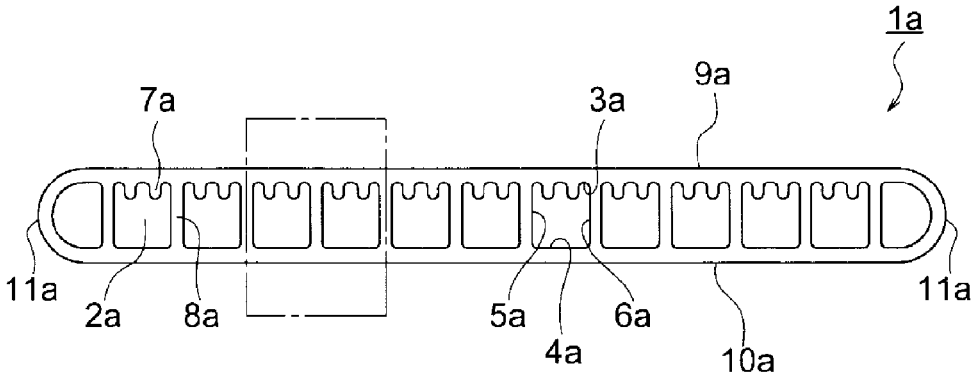
FIG. 2 is an enlarged view of the extruded aluminum flat multi-hole tube in FIG. 1 viewed from an opening side of a refrigerant passage.
Figure 3:
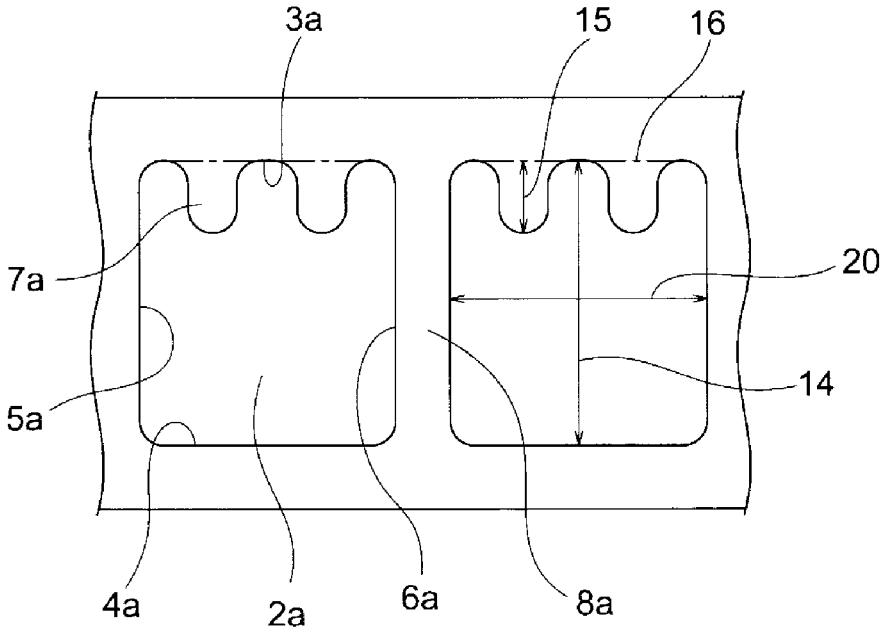
FIG. 3 is an enlarged view of portion A in FIG. 2.
Figure 4:
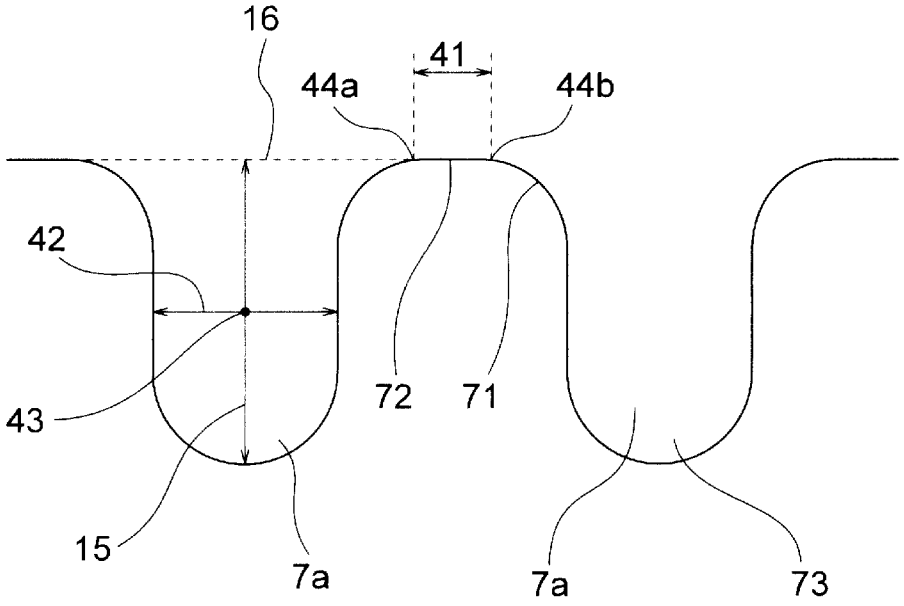
FIG. 4 is an enlarged view of a ridge and an inter-ridge flat portion in FIG. 3.

An extruded aluminum flat multi-hole tube according to a first embodiment of the present invention will be described with reference to FIGS. 1 to 3. FIG. 1 is a schematic perspective view of an example of the extruded aluminum flat multi-hole tube according to the first embodiment of the present invention. FIG. 2 is an enlarged view of the extruded aluminum flat multi-hole tube in FIG. 1 viewed from an opening side of a refrigerant passage. FIG. 3 is an enlarged view of portion A in FIG. 2. FIG. 4 is an enlarged view of a ridge and an inter-ridge flat portion in FIG. 3.

In FIGS. 1 to 3, an extruded aluminum flat multi-hole tube 1*a* is made of aluminum or aluminum alloy. The outer wall of the extruded aluminum flat multi-hole tube 1*a* includes a flat upper outer wall 9*a*, a flat lower outer wall 10*a*, and outer sidewalls 11*a* and 11*a* having an circular arcuate shape in a sectional view when cut along a plane perpendicular to a tube length direction of the extruded aluminum flat multi-hole tube 1*a*. In a sectional view when cut along a plane perpendicular to the tube length direction of the extruded aluminum flat multi-hole tube 1*a*, the wall surface of the upper outer wall 9*a* is parallel to the wall surface of the lower outer wall 10*a*.

The extruded aluminum flat multi-hole tube 1*a* includes a plurality of refrigerant passages 2*a* through which refrigerant flows. The refrigerant passages 2*a* extend in a tube length direction 17. Note that the tube length direction 17 is an extrusion direction of the extruded aluminum flat multi-hole tube 1*a*.

Each of the refrigerant passages 2*a* includes an upper wall surface 3*a* and a lower wall surface 4*a* opposed to each other; and a sidewall surface 5*a* and a sidewall surface 6*a* opposed to each other. A plurality of refrigerant passages 2*a* are formed in the tube by being partitioned by a partition wall 8*a*. In the extruded aluminum flat multi-hole tube 1*a*, a ridge 7*a* extending in the tube length direction is formed only on the upper wall surface 3*a* of the refrigerant passage 2*a*. Accordingly, in a sectional view when cut along a plane perpendicular to the tube length direction, the upper side of the refrigerant passage 2*a* has a substantially rectangular shape where protrusions are formed inwardly.

In the refrigerant passage 2*a*, as illustrated in FIG. 3, the height 15 of the ridge is 5 to 25% of the vertical width 14 of the refrigerant passage, particularly preferably 5 to 20% of the vertical width 14 of the refrigerant passage, more preferably 10 to 20% of the vertical width 14 of the refrigerant passage.

In the refrigerant passage 2*a*, as illustrated in FIG. 4, the ratio of the horizontal width 42 at ½ the height (at a position indicated by reference numeral 43) of the ridge 7*a* with respect to the horizontal width 20 of the refrigerant passage is 0.05 to 0.30, preferably 0.10 to 0.20, and the ratio of the horizontal width 41 per inter-ridge flat portion 72 of the upper wall surface 3*a* with respect to the horizontal width 20 of the refrigerant passage is 0.20 or less, preferably 0.05 to 0.15.

In the refrigerant passage 2*a*, as illustrated in FIG. 4, the top portion 73 of the ridge 7*a* has an arcuate or circular arcuate shape protruding toward the refrigerant passage 2*a*.

The extruded aluminum flat multi-hole tube according to the first embodiment of the present invention is an extruded aluminum flat multi-hole tube that is a flat multi-hole tube made of aluminum or aluminum alloy and manufactured by extrusion molding, wherein the flat multi-hole tube comprises therein a plurality of refrigerant passages extending in the tube length direction and including an upper wall surface and a lower wall surface opposed to each other and a pair of opposed sidewall surfaces, a ridge extending in the tube length direction is formed only on the upper wall surface of the refrigerant passage, the height of the ridge is 5 to 25% of the vertical width of the refrigerant passage, the ratio of the horizontal width at ½ the height of the ridge with respect to the horizontal width of the refrigerant passage is 0.05 to 0.30, and the ratio of the horizontal width per inter-ridge flat portion of the upper wall surface with respect to the horizontal width of the refrigerant passage is 0.20 or less.

The extruded aluminum flat multi-hole tube according to the first embodiment of the present invention is a flat tube made of aluminum or aluminum alloy and manufactured by extrusion molding of aluminum or aluminum alloy and is a multi-hole tube including a large number of refrigerant passages in the tube. The extruded aluminum flat multi-hole tube according to the first embodiment of the present invention includes a plurality of refrigerant passages through which refrigerant flows. The refrigerant passages extend in the tube length direction, namely, the extrusion direction.

The refrigerant passage includes an upper wall surface and a lower wall surface opposed to each other and a pair of opposed sidewall surfaces. In other words, the refrigerant passage is surrounded on all sides by the upper wall surface, the lower wall surface, one sidewall surface, and the other sidewall surface extending in the tube length direction. In the extruded aluminum flat multi-hole tube according to the first embodiment of the present invention, a ridge extending in the tube length direction is formed only on the upper wall surface of the refrigerant passage. Accordingly, in a sectional view when cut along a plane perpendicular to the tube length direction, the upper side of the refrigerant passage has a substantially rectangular shape where protrusions are formed inwardly. Note that four corners of the substantially rectangular refrigerant passage may be angled (may be at 90°) or may be arcuate.

In other words, the extruded aluminum flat multi-hole tube according to the first embodiment of the present invention comprises a plurality of refrigerant passages partitioned by a partition wall in the tube and extending in the tube length direction, wherein a ridge is formed only on the upper wall surface of the refrigerant passage.

Moreover, the outer wall of the extruded aluminum flat multi-hole tube according to the first embodiment of the present invention comprises a flat upper outer wall, a flat lower outer wall, and outer sidewalls having an circular arcuate shape in a sectional view when cut along a plane perpendicular to the tube length direction of the extruded flat multi-hole tube.

The number of ridges formed on the upper wall surface of each of the refrigerant passages of the extruded aluminum flat multi-hole tube according to the first embodiment of the present invention is preferably 1 to 4, particularly preferably 2 to 3, more preferably 1. Note that in the example illustrated in FIGS. 2 and 3, two ridges are formed on the upper wall surface of each of the refrigerant passages.

The height of the ridge is 5 to 25% of the vertical width of the refrigerant passage, preferably 5 to 20% of the vertical width of the refrigerant passage, particularly preferably 10 to 20% of the vertical width of the refrigerant passage. Note that as illustrated in FIG. 3, the height of the ridge refers to a length (reference numeral 15) from a wall surface position line (dotted line indicated by reference numeral 16) of the upper wall surface to the apex of the ridge. Note also that as illustrated in FIG. 3, the vertical width of the refrigerant passage refers to a length (reference numeral 14) from the wall surface position line (reference numeral 16) of the upper wall surface to the wall surface position line of the lower wall surface (the wall surface position line overlaps the wall surface for the wall surface with no ridge formed).

In the extruded aluminum flat multi-hole tube according to the first embodiment of the present invention, the ratio of the horizontal width at ½ the height of the ridge with respect to the horizontal width of the refrigerant passage is 0.05 to 0.30, preferably 0.10 to 0.20, and the ratio of the horizontal width per inter-ridge flat portion of the upper wall surface with respect to the horizontal width of the refrigerant passage is 0.20 or less, preferably 0.05 to 0.15. Note that as illustrated in FIG. 4, the horizontal width at ½ the height of the ridge refers to the horizontal width (reference numeral 42) of the ridge at a position (reference numeral 43) corresponding to ½ the height with respect to the height (reference numeral 15) of the ridge. Note also that as illustrated in FIG. 4, the inter-ridge flat portion of the upper wall surface refers to the flat portion of the upper wall surface existing between ridges and does not include a skirt portion (reference numeral 71) of the ridge having a curved surface. Accordingly, the horizontal width per inter-ridge flat portion of the upper wall surface refers to the length from an end point (reference numeral 44*a*) of the skirt portion of one ridge of the adjacent ridges to an end point (reference numeral 44*b*) of the skirt portion of the other ridge. If the ratio of the horizontal width at ½ the height of the ridge with respect to the horizontal width of the refrigerant passage is less than the above range, the ridge is too thin to manufacture and if the ratio exceeds the above range, refrigerant pressure drop is too large. Further, if the ratio of the horizontal width per inter-ridge flat portion of the upper wall surface with respect to the horizontal width of the refrigerant passage exceeds the above range, it is difficult to improve heat exchange performance.

In the extruded aluminum flat multi-hole tube according to the first embodiment of the present invention, the top portion of the ridge has an arcuate or circular arcuate shape protruding toward the refrigerant passage. Note that in the present invention, the expression "the top portion of the ridge has an arcuate or circular arcuate shape protruding toward the refrigerant passage" refers that in a sectional view when the extruded aluminum flat multi-hole tube is cut along a plane perpendicular to the tube length direction, the outline of the top portion of the ridge has an arcuate or circular arcuate shape protruding toward the refrigerant passage (the same applies below).

Both ends in the tube width direction of the extruded aluminum flat multi-hole tube according to the first embodiment of the present invention include refrigerant passages. A ridge may be formed or may not be formed on the upper wall surface of the refrigerant passages at both ends in the tube width direction of the extruded aluminum flat multi-hole tube according to the first embodiment of the present invention.

In the extruded aluminum flat multi-hole tube according to the first embodiment of the present invention, the evaporator has less decrease in the cross-sectional area of the refrigerant passage due to the ridge than a flat multi-hole tube where a ridge is formed on both wall surfaces of the upper wall surface and the lower wall surface of the refrigerant passage and thus suppresses an increase in flow resistance. In addition, in a flat multi-hole tube where a ridge is not formed on either wall surface of the upper wall surface or the lower wall surface of the refrigerant passage, refrigerant concentrates on the lower wall surface of the refrigerant passage, generating a so-called dryout phenomenon that the upper side surface of the refrigerant passage does not wet, causing heat exchange to drop extremely in the dryout generation portion. In contrast to this, in the extruded aluminum flat multi-hole tube according to the first embodiment of the present invention, refrigerant appropriately wets the upper wall surface, maintaining heat exchange on the upper wall surface and decreasing the liquid film thickness of the refrigerant on the lower wall surface. Therefore, flow resistance is difficult to increase. As described above, the extruded aluminum flat multi-hole tube according to the first embodiment of the present invention is suitable as a heat transfer tube for a heat exchanger of an evaporator since the evaporator suppresses an increase in flow resistance and exhibits excellent heat transfer performance.

Figure 5:
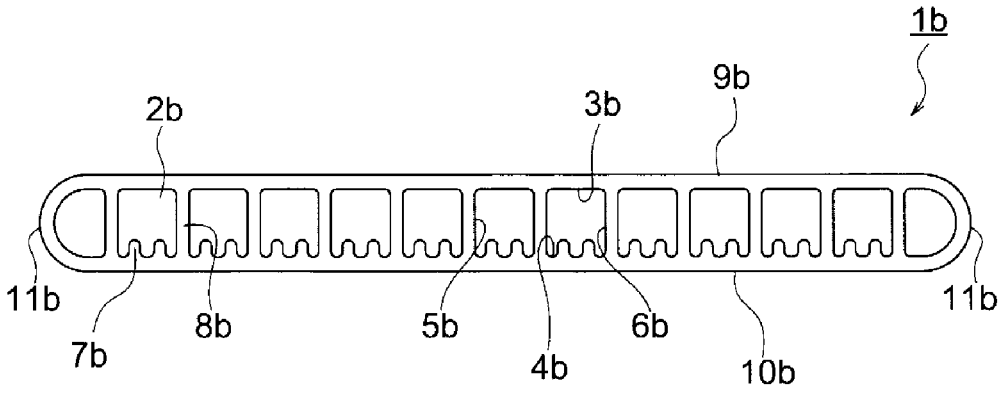
FIG. 5 is a schematic view of an example of an extruded aluminum flat multi-hole tube according to a second embodiment of the present invention viewed from an opening side of a refrigerant passage.

The extruded aluminum flat multi-hole tube according to the second embodiment of the present invention will be described with reference to FIG. 5. FIG. 5 is a schematic view of an example of the extruded aluminum flat multi-hole tube according to the second embodiment of the present invention viewed from an opening side of a refrigerant passage.

In FIG. 5, an extruded aluminum flat multi-hole tube 1*b* is made of aluminum or aluminum alloy. The outer wall of the extruded aluminum flat multi-hole tube 1*b* includes a flat upper outer wall 9*b*, a flat lower outer wall 10*b*, and outer sidewalls 11*b* and 11*b* having an circular arcuate shape in a sectional view when cut along a plane perpendicular to the tube length direction of the extruded aluminum flat multi-hole tube 1*b*. In a sectional view when cut along a plane perpendicular to the tube length direction of the extruded aluminum flat multi-hole tube 1*b*, the wall surface of the upper outer wall 9*b* is parallel to the wall surface of the lower outer wall 10*b*.

The extruded aluminum flat multi-hole tube 1*b* includes a plurality of refrigerant passages 2*b* through which refrigerant flows. The refrigerant passages 2*b* extend in the tube length direction. Note that the tube length direction is an extrusion direction of the extruded aluminum flat multi-hole tube 1*b*.

Each of the refrigerant passages 2*b* includes an upper wall surface 3*b* and a lower wall surface 4*b* opposed to each other; and a sidewall surface 5*b* and a sidewall surface 6*b* opposed to each other. A plurality of refrigerant passages 2*b* are formed in the tube by being partitioned by a partition wall 8*b*. In the extruded aluminum flat multi-hole tube 1*b*, a ridge 7*b* extending in the tube length direction is formed only on the lower wall surface 4*b* of the refrigerant passage 2*b*. Accordingly, in a sectional view when cut along a plane perpendicular to the tube length direction, the lower side of the refrigerant passage 2*b* has a substantially rectangular shape where protrusions are formed inwardly.

The extruded aluminum flat multi-hole tube according to the second embodiment of the present invention is an extruded aluminum flat multi-hole tube that is a flat multi-hole tube made of aluminum or aluminum alloy and manufactured by extrusion molding, wherein the flat multi-hole tube comprises therein a plurality of refrigerant passages extending in the tube length direction and including an upper wall surface and a lower wall surface opposed to each other and a pair of opposed sidewall surfaces, a ridge extending in the tube length direction is formed only on the lower wall surface of the refrigerant passage, the height of the ridge is 5 to 25% of the vertical width of the refrigerant passage, the ratio of the horizontal width at ½ the height of the ridge with respect to the horizontal width of the refrigerant passage is 0.05 to 0.30, and the ratio of the horizontal width per inter-ridge flat portion of the lower wall surface with respect to the horizontal width of the refrigerant passage is 0.20 or less.

The extruded aluminum flat multi-hole tube according to the second embodiment of the present invention is a flat tube made of aluminum or aluminum alloy and manufactured by extrusion molding of aluminum or aluminum alloy and is a multi-hole tube including a large number of refrigerant passages in the tube. The extruded aluminum flat multi-hole tube according to the second embodiment of the present invention includes a plurality of refrigerant passages through which refrigerant flows. The refrigerant passages extend in the tube length direction, namely, the extrusion direction.

The refrigerant passage includes an upper wall surface and a lower wall surface opposed to each other and a pair of opposed sidewall surfaces. In other words, the refrigerant passage is surrounded on all sides by the upper wall surface, the lower wall surface, one sidewall surface, and the other sidewall surface extending in the tube length direction. In the extruded aluminum flat multi-hole tube according to the second embodiment of the present invention, a ridge extending in the tube length direction is formed only on the lower wall surface of the refrigerant passage. Accordingly, in a sectional view when cut along a plane perpendicular to the tube length direction, the lower side of the refrigerant passage has a substantially rectangular shape where protrusions are formed inwardly. Note that four corners of the substantially rectangular refrigerant passage may be angled (may be at 90°) or may be arcuate.

In other words, the extruded aluminum flat multi-hole tube according to the second embodiment of the present invention comprises a plurality of refrigerant passages partitioned by a partition wall in the tube and extending in the tube length direction, wherein a ridge is formed only on the lower wall surface of the refrigerant passage.

Moreover, the outer wall of the extruded aluminum flat multi-hole tube according to the second embodiment of the present invention comprises a flat upper outer wall, a flat lower outer wall, and outer sidewalls having an circular arcuate shape in a sectional view when cut along a plane perpendicular to the tube length direction of the extruded flat multi-hole tube.

The number of ridges formed on the lower wall surface of each of the refrigerant passages of the extruded aluminum flat multi-hole tube according to the second embodiment of the present invention is preferably 1 to 4, particularly preferably 2 to 3, more preferably 1. Note that in the example illustrated in FIG. 5, two ridges are formed on the lower wall surface of each of the refrigerant passages.

The height of the ridge is 5 to 25% of the vertical width of the refrigerant passage, preferably 5 to 20% of the vertical width of the refrigerant passage, particularly preferably 10 to 20% of the vertical width of the refrigerant passage. Note that the height of the ridge refers to a length from a wall surface position line of the lower wall surface to the apex of the ridge. Note also that the vertical width of the refrigerant passage refers to a length from the wall surface position line of the lower wall surface to the wall surface position line of the upper wall surface (the wall surface position line overlaps the wall surface for the wall surface with no ridge formed).

In the extruded aluminum flat multi-hole tube according to the second embodiment of the present invention, the ratio of the horizontal width at ½ the height of the ridge with respect to the horizontal width of the refrigerant passage is 0.05 to 0.30, preferably 0.10 to 0.20, and the ratio of the horizontal width per inter-ridge flat portion of the lower wall surface with respect to the horizontal width of the refrigerant passage is 0.20 or less, preferably 0.05 to 0.15. Note that the horizontal width at ½ the height of the ridge refers to the horizontal width of the ridge at a position corresponding to ½ the height with respect to the height of the ridge. Note also that the inter-ridge flat portion of the lower wall surface refers to the flat portion of the lower wall surface existing between ridges and does not include a skirt portion of the ridge having a curved surface. Accordingly, the horizontal width per inter-ridge flat portion of the lower wall surface refers to the length from an end point of the skirt portion of one ridge of the adjacent ridges to an end point of the skirt portion of the other ridge. If the ratio of the horizontal width at ½ the height of the ridge with respect to the horizontal width of the refrigerant passage is less than the above range, the ridge is too thin to manufacture and if the ratio exceeds the above range, refrigerant pressure drop is too large. Further, if the ratio of the horizontal width per inter-ridge flat portion of the lower wall surface with respect to the horizontal width of the refrigerant passage exceeds the above range, it is difficult to improve heat exchange performance.

In the extruded aluminum flat multi-hole tube according to the second embodiment of the present invention, the top portion of the ridge has an arcuate or circular arcuate shape protruding toward the refrigerant passage.

Both ends in the tube width direction of the extruded aluminum flat multi-hole tube according to the second embodiment of the present invention include refrigerant passages. A ridge may be formed or may not be formed on the lower wall surface of the refrigerant passages at both ends in the tube width direction of the extruded aluminum flat multi-hole tube according to the second embodiment of the present invention.

In the extruded aluminum flat multi-hole tube according to the second embodiment of the present invention, the condenser has less decrease in the cross-sectional area of the refrigerant passage due to the ridge than a flat multi-hole tube where a ridge is formed on both wall surfaces of the upper wall surface and the lower wall surface of the refrigerant passage and thus suppresses an increase in flow resistance. Meanwhile, in a flat multi-hole tube where a ridge is not formed on either wall surface of the upper wall surface or the lower wall surface of the refrigerant passage, as condensed refrigerant accumulates on the lower wall surface of the refrigerant passage, condensation is unlikely to occur on the lower wall surface of the refrigerant passage. In contrast to this, in the case where a ridge is formed on the lower wall surface of the refrigerant passage, even if condensed refrigerant accumulates on the lower wall surface of the refrigerant passage, the tip of the ridge portion is not immersed in refrigerant but protrudes into a gas phase, and condensation continues in a portion protruding into the gas phase, thus exhibiting excellent heat transfer performance. As described above, the extruded aluminum flat multi-hole tube according to the second embodiment of the present invention is suitable as a heat transfer tube for a heat exchanger of a condenser since the condenser suppresses an increase in flow resistance due to the ridge and exhibits excellent heat transfer performance.

Figure 6:
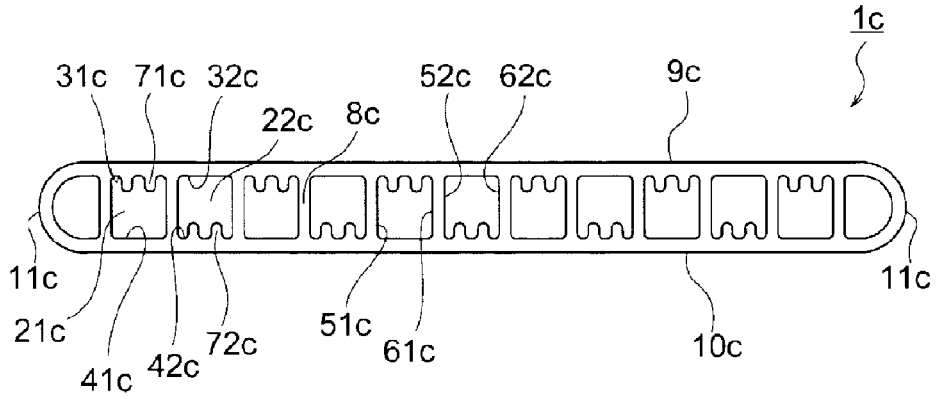
FIG. 6 is a schematic view of an example of an extruded aluminum flat multi-hole tube according to a third embodiment of the present invention viewed from an opening side of a refrigerant passage.

The extruded aluminum flat multi-hole tube according to a third embodiment of the present invention will be described with reference to FIG. 6. FIG. 6 is a schematic view of an example of the extruded aluminum flat multi-hole tube according to the third embodiment of the present invention viewed from an opening side of a refrigerant passage.

In FIG. 6, an extruded aluminum flat multi-hole tube 1*c* is made of aluminum or aluminum alloy. The outer wall of the extruded aluminum flat multi-hole tube 1*c* includes a flat upper outer wall 9*c*, a flat lower outer wall 10*c*, and outer sidewalls 11*c* and 11*c* having an circular arcuate shape in a sectional view when cut along a plane perpendicular to the tube length direction of the extruded aluminum flat multi-hole tube 1*c*. In a sectional view when cut along a plane perpendicular to the tube length direction of the extruded aluminum flat multi-hole tube 1*c*, the wall surface of the upper outer wall 9*c* is parallel to the wall surface of the lower outer wall 10*c*.

The extruded aluminum flat multi-hole tube 1*c* includes a plurality of refrigerant passages 21*c* and 22*c* through which refrigerant flows. The refrigerant passages 21*c* and 22*c* extend in the tube length direction. Note that the tube length direction is an extrusion direction of the extruded aluminum flat multi-hole tube 1*c*.

The refrigerant passage 21*c* includes an upper wall surface 31*c* and a lower wall surface 41*c* opposed to each other; and a sidewall surface 51*c* and a sidewall surface 61*c* opposed to each other. In addition, the refrigerant passage 22*c* includes an upper wall surface 32*c* and a lower wall surface 42*c* opposed to each other; and a sidewall surface 52*c* and a sidewall surface 62*c* opposed to each other. Each of a plurality of refrigerant passages 21*c* and 22*c* are formed in the tube by being partitioned by a partition wall 8*c*. In the extruded aluminum flat multi-hole tube 1*c*, the refrigerant passage is a combination of the refrigerant passage 21*c* (upper wall surface ridge forming refrigerant passage) where ridges 71*c* extending in the tube length direction are formed only on the upper wall surface 31*c* and the refrigerant passage 22*c* (lower wall surface ridge forming refrigerant passage) where ridges 72*c* extending in the tube length direction are formed only on the lower wall surface 42*c*. Accordingly, in a sectional view when cut along a plane perpendicular to the tube length direction, the upper side of the upper wall surface ridge forming refrigerant passage 21*c* has a substantially rectangular shape where protrusions are formed inwardly, and in a sectional view when cut along a plane perpendicular to the tube length direction, the lower side of the lower wall surface ridge forming refrigerant passage 22*c* has a substantially rectangular shape where protrusions are formed inwardly.

The extruded aluminum flat multi-hole tube according to the third embodiment of the present invention is an extruded aluminum flat multi-hole tube that is a flat multi-hole tube made of aluminum or aluminum alloy and manufactured by extrusion molding, wherein the flat multi-hole tube comprises therein a plurality of refrigerant passages extending in the tube length direction and including an upper wall surface and a lower wall surface opposed to each other and a pair of opposed sidewall surfaces, a plurality of the refrigerant passages are a combination of the upper wall surface ridge forming refrigerant passage where a ridge extending in the tube length direction is formed only on the upper wall surface and the lower wall surface ridge forming refrigerant passage where a ridge extending in the tube length direction is formed only on the lower wall surface, the height of the ridge is 5 to 25% of the vertical width of the refrigerant passage, the ratio of the horizontal width at ½ the height of the ridge with respect to the horizontal width of the refrigerant passage is 0.05 to 0.30, the ratio of the horizontal width per inter-ridge flat portion of the upper wall surface with respect to the horizontal width of the refrigerant passage is 0.20 or less, and the ratio of the horizontal width per inter-ridge flat portion of the lower wall surface with respect to the horizontal width of the refrigerant passage is 0.20 or less.

The extruded aluminum flat multi-hole tube according to the third embodiment of the present invention is a flat tube made of aluminum or aluminum alloy and manufactured by extrusion molding of aluminum or aluminum alloy and is a multi-hole tube including a large number of refrigerant passages in the tube. The extruded aluminum flat multi-hole tube according to the third embodiment of the present invention includes a plurality of refrigerant passages through which refrigerant flows. The refrigerant passages extend in the tube length direction, namely, the extrusion direction.

The refrigerant passage includes an upper wall surface and a lower wall surface opposed to each other and a pair of opposed sidewall surfaces. In other words, the refrigerant passage is surrounded on all sides by the upper wall surface, the lower wall surface, one sidewall surface, and the other sidewall surface extending in the tube length direction. The extruded aluminum flat multi-hole tube according to the third embodiment of the present invention includes an upper wall surface ridge forming refrigerant passage where a ridge extending in the tube length direction is formed only on the upper wall surface and a lower wall surface ridge forming refrigerant passage where a ridge extending in the tube length direction is formed only on the lower wall surface. Accordingly, in a sectional view when cut along a plane perpendicular to the tube length direction, the upper side of the upper wall surface ridge forming refrigerant passage has a substantially rectangular shape where protrusions are formed inwardly, and in a sectional view when cut along a plane perpendicular to the tube length direction, the lower side of the lower wall surface ridge forming refrigerant passage has a substantially rectangular shape where protrusions are formed inwardly. Note that four corners of the substantially rectangular upper wall surface ridge forming refrigerant passage and lower wall surface ridge forming refrigerant passage may be angled (may be at 90°) or may be arcuate.

In other words, the extruded aluminum flat multi-hole tube according to the third embodiment of the present invention comprises a plurality of refrigerant passages extending in the tube length direction and partitioned by a partition wall in the tube. The plurality of refrigerant passages are a combination of a refrigerant passage where a ridge is formed only on the upper wall surface and a refrigerant passage where a ridge is formed only on the lower wall surface.

Further, the outer wall of the extruded aluminum flat multi-hole tube according to the third embodiment of the present invention includes a flat upper outer wall, a flat lower outer wall, and outer sidewalls having an circular arcuate shape in a sectional view when cut along a plane perpendicular to the tube length direction of the extruded flat multi-hole tube.

The number of ridges formed on the upper wall surface or the lower wall surface of each of the refrigerant passages of the extruded aluminum flat multi-hole tube according to the third embodiment of the present invention is preferably 1 to 4, particularly preferably 2 to 3, more preferably 1. Note that in the example illustrated in FIG. 6, two ridges are formed on the upper wall surface or the lower wall surface of each of the refrigerant passages.

The height of the ridge is 5 to 25% of the vertical width of the refrigerant passage, preferably 5 to 20% of the vertical width of the refrigerant passage, particularly preferably 10 to 20% of the vertical width of the refrigerant passage. Note that in the upper wall surface ridge forming refrigerant passage, the height of the ridge refers to a length from the wall surface position line of the upper wall surface to the apex of the ridge, and the vertical width of the refrigerant passage refers to a length from the wall surface position line of the upper wall surface to the wall surface position line of the lower wall surface. Note also that in the lower wall surface ridge forming refrigerant passage, the height of the ridge refers to the length from the wall surface position line of the lower wall surface to the apex of the ridge, and the vertical width of the refrigerant passage refers to the length from the wall surface position line of the lower wall surface to the wall surface position line of the upper wall surface.

In the extruded aluminum flat multi-hole tube according to the third embodiment of the present invention, the ratio of the horizontal width at ½ the height of the ridge with respect to the horizontal width of the refrigerant passage is 0.05 to 0.30, preferably 0.10 to 0.20, the ratio of the horizontal width per inter-ridge flat portion of the upper wall surface with respect to the horizontal width of the refrigerant passage is 0.20 or less, preferably 0.05 to 0.15, and the ratio of the horizontal width per inter-ridge flat portion of the lower wall surface with respect to the horizontal width of the refrigerant passage is 0.20 or less, preferably 0.05 to 0.15. Note that the horizontal width at ½ the height of the ridge refers to the horizontal width of the ridge at a position corresponding to ½ the height with respect to the height of the ridge. Note also that the inter-ridge flat portion of the upper wall surface refers to the flat portion of the lower wall surface existing between ridges and does not include a skirt portion of the ridge having a curved surface. Accordingly, the horizontal width per inter-ridge flat portion of the upper wall surface refers to the length from an end point of the skirt portion of one ridge of the adjacent ridges to an end point of the skirt portion of the other ridge. Note also that the inter-ridge flat portion of the lower wall surface refers to the flat portion of the lower wall surface existing between ridges and does not include a skirt portion of the ridge having a curved surface. Accordingly, the horizontal width per inter-ridge flat portion of the lower wall surface refers to the length from an end point of the skirt portion of one ridge of the adjacent ridges to an end point of the skirt portion of the other ridge. If the ratio of the horizontal width at ½ the height of the ridge with respect to the horizontal width of the refrigerant passage is less than the above range, the ridge is too thin to manufacture and if the ratio exceeds the above range, refrigerant pressure drop is too large. Further, if the ratio of the horizontal width per inter-ridge flat portion of the upper wall surface with respect to the horizontal width of the refrigerant passage exceeds the above range, it is difficult to improve heat exchange performance. Furthermore, if the ratio of the horizontal width per inter-ridge flat portion of the lower wall surface with respect to the horizontal width of the refrigerant passage exceeds the above range, it is difficult to improve heat exchange performance.

In the extruded aluminum flat multi-hole tube according to the third embodiment of the present invention, the top portion of the ridge has an arcuate or circular arcuate shape protruding toward the refrigerant passage.

Both ends in the tube width direction of the extruded aluminum flat multi-hole tube according to the third embodiment of the present invention include refrigerant passages. In the refrigerant passages at both ends in the tube width direction of the extruded aluminum flat multi-hole tube according to the third embodiment of the present invention, a ridge may be formed on the upper wall surface or the lower wall surface, or a ridge may not be formed on the upper wall surface or the lower wall surface.

In the extruded aluminum flat multi-hole tube according to the third embodiment of the present invention, the ratio of the number of upper wall surface ridge forming refrigerant passages and the number of lower wall surface ridge forming refrigerant passages is preferably 2:8 to 8:2.

In the extruded aluminum flat multi-hole tube according to the third embodiment of the present invention, the upper wall surface ridge forming refrigerant passage and the lower wall surface ridge forming refrigerant passage are preferably alternately repeated.

In the extruded aluminum flat multi-hole tube according to the third embodiment of the present invention, the evaporator and the condenser have higher heat transfer performance than those of the flat multi-hole tube where a ridge is formed on both wall surfaces of the upper wall surface and the lower wall surface of the refrigerant passage. Thus, the extruded aluminum flat multi-hole tube according to the third embodiment of the present invention is suitable as a heat transfer tube for a heat exchanger of the evaporator and the condenser since the evaporator and the condenser suppress an increase in flow resistance due to the ridge and exhibit excellent heat transfer performance.

Examples of the aluminum material constituting the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention include A1000 series pure aluminum and A3000 series aluminum alloy containing 0.3 to 1.4% by mass of Mn and 0.05 to 0.7% by mass of Cu.

The tube width of the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention may be appropriately selected, but is preferably 10 to 50 mm, particularly preferably 10 to 30 mm. Note that the tube width of the extruded flat multi-hole tube refers to the width of the extruded flat multi-hole tube in a direction perpendicular to the tube length direction, namely, the length indicated by reference numeral 18 in FIG. 1.

The thickness of the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention may be appropriately selected, but is preferably 1 to 5 mm, particularly preferably 1 to 3 mm. Note that the thickness of the extruded flat multi-hole tube refers to the length indicated by reference numeral 19 in FIG. 1, namely, the length from the upper outer wall to the lower outer wall in a sectional view when cut along a plane perpendicular to the tube length direction of the extruded flat multi-hole tube.

In the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention, the ratio of the vertical width of the refrigerant passage with respect to the thickness of the extruded flat multi-hole tube may be appropriately selected, but is preferably 0.4 to 0.85, particularly preferably 0.5 to 0.8.

In the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention, the horizontal width of the refrigerant passage may be appropriately selected, but is preferably 0.45 to 2 mm, particularly preferably 0.5 to 1 mm. Note that the horizontal width of the refrigerant passage refers to the length indicated by reference numeral 20 in FIG. 3, namely, the length from one sidewall surface of the refrigerant passage to the other sidewall surface thereof.

In the extruded aluminum flat multi-hole tube according to the first embodiment of the present invention, the extruded aluminum flat multi-hole tube according to the second embodiment of the present invention, and the extruded aluminum flat multi-hole tube according to the third embodiment of the present invention, the number of refrigerant passages may be appropriately selected, but is preferably 5 to 30, particularly preferably 8 to 20.

Figure 7:
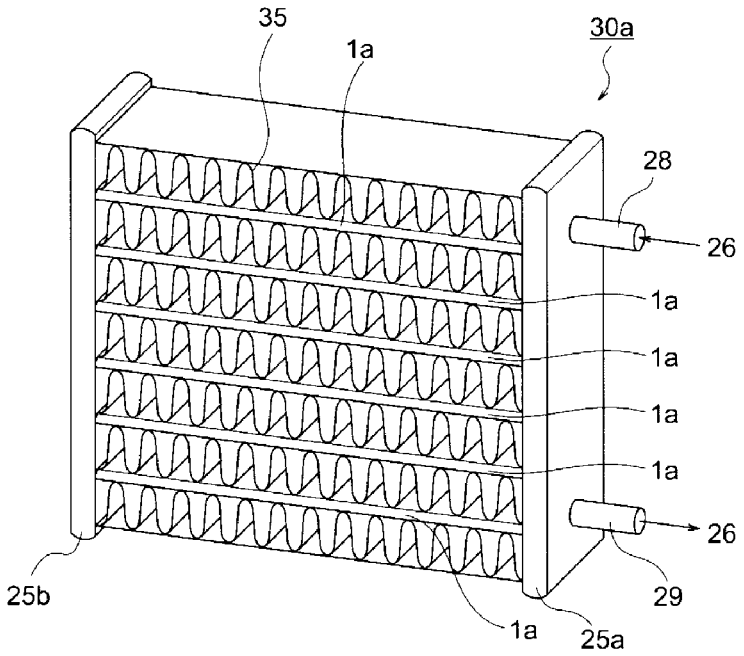
FIG. 7 is a schematic perspective view of an example of a heat exchanger according to the first embodiment of the present invention.
Figure 8:
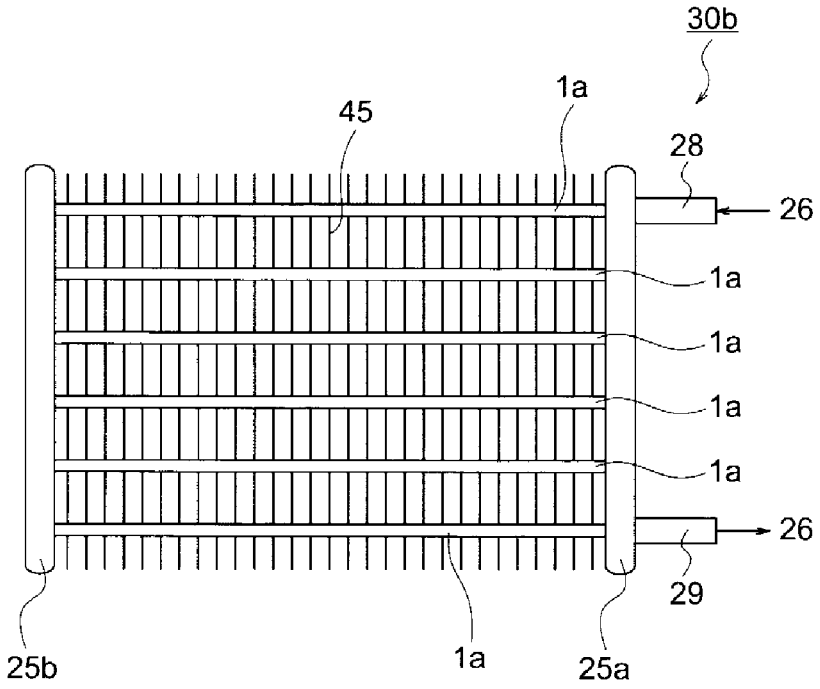
FIG. 8 is a schematic front view of another example of the heat exchanger according to the first embodiment of the present invention.

The heat exchanger according to the first embodiment of the present invention will be described with reference to FIGS. 7 and 8. FIG. 7 is a schematic view of an example of the heat exchanger according to the first embodiment of the present invention and is a perspective view of the heat exchanger. FIG. 8 is a schematic view of another example of the heat exchanger according to the first embodiment of the present invention and is a front view of the heat exchanger.

In FIG. 7, a heat exchanger 30*a* is configured such that a plurality of extruded aluminum flat multi-hole tubes 1*a* are arranged in rows with both ends thereof being inserted into and fixed to headers 25*a* and 25*b* so that the refrigerant passages are connected to inside the headers 25*a* and 25*b*, and a plurality of corrugated aluminum heat dissipating fins 35 are fixed to between the extruded aluminum flat multi-hole tubes 1*a* arranged in rows. Further, an inlet port 28 of refrigerant 26 is attached to an upper side of the header 25*a*, and an outlet port 29 of refrigerant 26 is attached to a lower side of the header 25*a*. In other words, the inlet port 28 is disposed on one end side of the header 25*a*, and the outlet port 29 is disposed on the other end side of the header 25*a*. Note that a partition is provided inside the header 25*a* and the header 25*b* to prevent refrigerant from flowing in the header by shortcut. Note also that the inlet port 28 may be disposed on the upper side of one of the header 25*a* and the header 25*b*, and the outlet port 29 may be disposed on the lower side of the other of the header 25*a* and the header 25*b*. FIG. 7 illustrates a case where the heat exchanger 30*a* operates as a condenser. In a case where the heat exchanger 30*a* operates as an evaporator, the inlet port 28 and the outlet port 29 are reversed. More specifically, in the case where the heat exchanger 30*a* operates as an evaporator, refrigerant is introduced from the lower side of the header 25*a* and refrigerant is discharged from the upper side of the header 25*a*.

In FIG. 8, a heat exchanger 30*b* is configured such that a plurality of extruded aluminum flat multi-hole tubes 1*a* are arranged in rows with both ends thereof being inserted into and fixed to the headers 25*a* and 25*b* so that the refrigerant passages are connected to inside the headers 25*a* and 25*b*, and the extruded aluminum flat multi-hole tubes 1*a* arranged in rows are fitted and fixed to slits of a large number of plate-like heat dissipating fins 45 spaced at a specific distance in the tube length direction of the extruded aluminum flat multi-hole tubes 1*a*. Further, an inlet port 28 of refrigerant 26 is attached to an upper side of the header 25*a*, and an outlet port 29 of refrigerant 26 is attached to a lower side of the header 25*a*. In other words, the inlet port 28 is disposed on one end side of the header 25*a*, and the outlet port 29 is disposed on the other end side of the header 25*a*. Note that a partition is provided inside the header 25*a* and the header 25*b* to prevent refrigerant from flowing in the header by shortcut. Note also that the inlet port 28 may be disposed on the upper side of one of the header 25*a* and the header 25*b*, and the outlet port 29 may be disposed on the lower side of the other of the header 25*a* and the header 25*b*. FIG. 8 illustrates a case where the heat exchanger 30*b* operates as a condenser. In a case where the heat exchanger 30*b* operates as an evaporator, the inlet port 28 and the outlet port 29 are reversed. More specifically, in the case where the heat exchanger 30*b* operates as an evaporator, refrigerant is introduced from the lower side of the header 25*a* and refrigerant is discharged from the upper side of the header 25*a*.

In the heat exchanger 30*a* and the heat exchanger 30*b*, the refrigerant 26 is supplied from the inlet port 28 into the header 25*a*, then repeats passing through the refrigerant passage in the extruded aluminum flat multi-hole tube 1*a*, flowing into the header 25*b*, then passing through the refrigerant passage in the extruded aluminum flat multi-hole tube 1*a*, and flowing into the header 25*a*, and finally is discharged from the outlet port 29.

The heat exchanger according to the first embodiment of the present invention is a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the first embodiment of the present invention.

The heat exchanger according to the first embodiment of the present invention comprises a plurality of the extruded aluminum flat multi-hole tubes according to the first embodiment of the present invention and a plurality of heat dissipating fins. In the heat exchanger according to the first embodiment of the present invention, the heat dissipating fins are made of aluminum or aluminum alloy.

In the heat exchanger according to the first embodiment of the present invention, a plurality of the extruded aluminum flat multi-hole tubes according to the first embodiment of the present invention are arranged in rows spaced at a specific distance so that the flat surface of the upper outer wall faces upward. Further, in the heat exchanger according to the first embodiment of the present invention, a plurality of heat dissipating fins are fixed to the extruded aluminum flat multi-hole tubes according to the first embodiment of the present invention arranged in rows.

Examples of the heat dissipating fin include a corrugated fin and a flat plate-like fin. Examples of the corrugated fin material include a brazing sheet material where a brazing material is clad on both surfaces of a core material (for example, an A3000 series core material) and a bare fin material where a brazing material is not clad.

In the heat exchanger according to the first embodiment of the present invention, both ends of a plurality of the extruded aluminum flat multi-hole tubes according to the first embodiment of the present invention arranged in rows are inserted and fixed to a pair of headers so that the refrigerant passages are connected thereto. The refrigerant inlet port and the refrigerant outlet port are attached to one header, or the refrigerant inlet port is attached to one header and the refrigerant outlet port is attached to the other header. From the viewpoint of improving heat exchange efficiency, the refrigerant inlet port and the refrigerant outlet port are commonly attached on the diagonal sides of the core portion including the extruded aluminum flat multi-hole tubes and the heat dissipating fins according to the first embodiment of the present invention or on the upper and lower sides of one header.

In the heat exchanger according to the first embodiment of the present invention, in the case where the heat dissipating fins are corrugated fins, the core portion of the heat exchanger has a structure in which the extruded aluminum flat multi-hole tubes and the corrugated fins according to the first embodiment of the present invention are alternately stacked. When a heat exchanger is manufactured using a corrugated brazing sheet material, for example, a binder and a mixture of fluxes such as $KZnF_3$ are applied to the surfaces of the upper outer wall and the lower outer wall of the extruded aluminum flat multi-hole tube according to the first embodiment of the present invention. Then, an extruded flat multi-hole tube and a corrugated brazing sheet material are alternately stacked, both ends of the extruded flat multi-hole tube are inserted into a pair of headers, a refrigerant inlet port and a refrigerant outlet port are attached to the headers to be heat-brazed. As a result, the heat exchanger is manufactured. When a heat exchanger is manufactured using a corrugated bare fin material, for example, a brazing material such as an Si powder, a binder, and a mixture of fluxes such as $KZnF_3$ are applied to the surfaces of the upper outer wall and the lower outer wall of the extruded aluminum flat multi-hole tube according to the first embodiment of the present invention. Then, an extruded flat multi-hole tube and a corrugated bare fin material are alternately stacked, both ends of the extruded flat multi-hole tube are inserted into a pair of headers, a refrigerant inlet port and a refrigerant outlet port are attached to the headers to be heat-brazed. As a result, the heat exchanger is manufactured.

In the heat exchanger according to the first embodiment of the present invention, in the case where the heat dissipating fins are plate fins, the core portion of the heat exchanger has a structure in which the extruded aluminum flat multi-hole tubes according to the first embodiment of the present invention arranged in rows spaced at a specific distance are fitted in a large number of plate fins arranged in rows spaced at a specific distance in the tube length direction of the extruded flat multi-hole tubes. For example, slits are formed in the plate fins so that the extruded aluminum flat multi-hole tubes according to the first embodiment of the present invention are fitted. Then, a large number of plate fins in which the slits are formed are spaced at a specific distance, the extruded flat multi-hole tubes are fitted into the slits of the plate fins, both ends of the extruded flat multi-hole tube are inserted into a pair of headers, and a refrigerant inlet port and a refrigerant outlet port are attached to the headers. As a result, the heat exchanger is manufactured.

The heat exchanger according to the second embodiment of the present invention is a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the second embodiment of the present invention.

The heat exchanger according to the second embodiment of the present invention is the same as the heat exchanger according to the first embodiment of the present invention in terms of the used extruded flat multi-hole tube except that the former uses the extruded aluminum flat multi-hole tubes according to the second embodiment of the present invention while the latter uses the extruded aluminum flat multi-hole tubes according to the first embodiment of the present invention.

The heat exchanger according to the third embodiment of the present invention is a heat exchanger comprising a plurality of flat multi-hole tubes arranged in rows and a plurality of heat dissipating fins fixed to the flat multi-hole tubes, wherein a plurality of the flat multi-hole tubes are a combination of the extruded aluminum flat multi-hole tubes according to the first embodiment of the present invention and the extruded aluminum flat multi-hole tubes according to the second embodiment of the present invention, the extruded aluminum flat multi-hole tubes according to the first embodiment of the present invention are arranged on the gas phase side and the extruded aluminum flat multi-hole tubes according to the second embodiment of the present invention are arranged on the liquid phase side.

The heat exchanger according to the third embodiment of the present invention is the same as the heat exchanger according to the first embodiment of the present invention in terms of the used extruded flat multi-hole tubes except that the former uses a combination of the extruded aluminum flat multi-hole tubes according to the first embodiment of the present invention and the extruded aluminum flat multi-hole tubes according to the second embodiment of the present invention, while the latter uses the extruded aluminum flat multi-hole tubes according to the first embodiment of the present invention.

Further, in the heat exchanger according to the third embodiment of the present invention, the extruded aluminum flat multi-hole tubes according to the first embodiment of the present invention are disposed on the gas phase side, and the extruded aluminum flat multi-hole tubes according to the second embodiment of the present invention are disposed on the liquid phase side. Note that in the case where the heat exchanger is used a condenser like the heat exchangers 30*a* and 30*b* in FIGS. 7 and 8, the gas phase side refers to the upper side, namely, a position closer to the refrigerant inlet port, and the liquid phase side refers to the lower side, namely, a position closer to the refrigerant outlet port. Note also that in the case where the heat exchanger is used as an evaporator, the gas phase side refers to the upper side, namely, a position closer to the refrigerant outlet port, and the liquid phase side refers to the lower side, namely, a position closer to the refrigerant inlet port.

The heat exchanger according to the fourth embodiment of the present invention is a heat exchanger comprising a plurality of flat multi-hole tubes arranged in rows and a plurality of heat dissipating fins fixed to the flat multi-hole tubes, wherein the flat multi-hole tubes are the extruded aluminum flat multi-hole tubes according to the third embodiment of the present invention.

The heat exchanger according to the fourth embodiment of the present invention is the same as the heat exchanger according to the first embodiment of the present invention in terms of the used extruded flat multi-hole tubes except that the former uses the extruded aluminum flat multi-hole tubes according to the third embodiment of the present invention, while the latter uses the extruded aluminum flat multi-hole tubes according to the first embodiment of the present invention.

The air conditioner includes a compressor and an expansion valve disposed between a heat exchanger for evaporator and a heat exchanger for condenser connected by a pipe. The air conditioner circulates refrigerant starting at the compressor to the heat exchanger for condenser (heat dissipation), through the expansion valve to the heat exchanger for evaporator (heat absorption), back to the compressor in that order for heat exchange. In general, a gas phase refrigerant is compressed by the compressor to increase the temperature and then is introduced into the heat exchanger for condensation in a gas phase state. When heat is dissipated, the refrigerant is condensed and changed into a liquid phase state. Then, the liquid phase refrigerant passes through the expansion valve to be rapidly depressurized, and then is introduced into the heat exchanger for evaporator. Then, the refrigerant changes into the gas phase while absorbing the surrounding heat, and then is discharged from the heat exchanger for evaporator. Heat exchange is performed by repeating the cycle of compressing the gas phase refrigerant by the compressor. Thus, in the case of the heat exchanger for condenser, the inlet port side is the gas phase side and the outlet port side is the liquid phase side. In contrast to this, in the case of the heat exchanger for evaporator, the inlet port side is the liquid phase side and the outlet port side is the gas phase side.

In the case of using the air conditioner as an automotive air conditioner, cooling operation can be performed by using a heat exchanger for indoor unit as the heat exchanger for evaporator and a heat exchanger for outdoor unit as the heat exchanger for condenser. Meanwhile, heating operation can be performed by using a heat exchanger for heat dissipation flowing high-temperature radiator cooling water separately from the heat exchanger for indoor unit.

When the air conditioner is used for indoor air conditioning, the heat exchanger can be used for both the heat exchanger for condenser and the heat exchanger for evaporator. Heating operation can be performed by using a heat exchanger for indoor unit as the heat exchanger for condenser and a heat exchanger for outdoor unit as the heat exchanger for evaporator, while cooling operation can be performed by using a heat exchanger for indoor unit as the heat exchanger for evaporator and a heat exchanger for outdoor unit as the heat exchanger for condenser.

Thus, the heat exchanger according to the first embodiment of the present invention is suitable as the heat exchanger for evaporator since such heat exchanger, particularly in the case of evaporation, suppresses an increase in flow resistance due to the ridge and has higher heat transfer performance than the flat multi-hole tubes where a ridge is formed on both wall surfaces of the upper wall surface and the lower wall surface of the refrigerant passage. Further, the heat exchanger according to the second embodiment of the present invention is suitable as the heat exchanger for condenser since such heat exchanger, in the case of condensation, suppresses an increase in flow resistance due to the ridge and has higher heat transfer performance than the flat multi-hole tubes where a ridge is formed on both wall surfaces of the upper wall surface and the lower wall surface of the refrigerant passage. Furthermore, the heat exchanger according to the third embodiment of the present invention is suitable as the heat exchanger for both evaporator and condenser since such heat exchanger, in the case of either of evaporation and condensation, suppress an increase in flow resistance due to the ridge and have higher heat transfer performance than the flat multi-hole tubes where a ridge is formed on both wall surfaces of the upper wall surface and the lower wall surface of the refrigerant passage. Still furthermore, the heat exchanger according to the fourth embodiment of the present invention is suitable as the heat exchanger for both evaporator and condenser since such heat exchanger, in the case of either of evaporation and condensation, suppress an increase in flow resistance due to the ridge and have higher heat transfer performance than the flat multi-hole tubes where a ridge is formed on both wall surfaces of the upper wall surface and the lower wall surface of the refrigerant passage, as well as eliminate time and effort to distinguish between a heat transfer tube in which a ridge is formed only on the upper wall surface and a heat transfer tube in which a ridge is formed only on the lower wall surface during manufacturing.

Hereinafter, the present invention will be specifically described with reference to examples, but the present invention is not limited thereto.

EXAMPLES

Examples and Comparative Examples

The extruded flat multi-hole tubes were manufactured by using A1100 as the aluminum material to extrude and mold the flat multi-hole tubes of various dimensions as shown in Tables 1 and 2. Note that example 1A, comparative example 1B, and comparative example 1C indicate that a ridge is formed only on the upper wall surface; example 2A, comparative example 2B, and comparative example 2C indicate that a ridge is formed only on the lower wall surface; example 3A, comparative example 3B, and comparative example 3C indicate that a refrigerant passage where a ridge is formed only on the upper wall surface and a refrigerant passage where a ridge is formed only on the lower wall surface are alternately repeated; comparative example 4 indicates that a ridge is not formed on the upper wall surface or the lower wall surface; and comparative example 5 indicates that a ridge is formed on the upper wall surface and the lower wall surface.

TABLE 1

| | Example 1A | Example 2A | Example 3A | Comparative example 1B | Comparative example 2B | Comparative example 3B |
|---|---|---|---|---|---|---|
| refrigerant passage shape | ridge on upper side | ridge on lower side | alternately on upper and lower | ridge on upper side | ridge on lower side | alternately on upper and lower |
| number of refrigerant passages | 20 | 20 | 20 | 20 | 20 | 20 |
| vertical width of refrigerant passage (mm) | 0.77 | 0.77 | 0.77 | 0.77 | 0.77 | 0.77 |
| horizontal width of refrigerant passage (mm) | 0.68 | 0.68 | 0.68 | 0.68 | 0.68 | 0.68 |
| vertical width of refrigerant passage/thickness of flat multi-hole tube | 0.53 | 0.53 | 0.53 | 0.53 | 0.53 | 0.53 |
| height of ridge (mm) | 0.15 | 0.15 | 0.15 | 0.15 | 0.15 | 0.15 |
| horizontal width at ½ height of ridge (mm) | 0.13 | 0.13 | 0.13 | 0.23 | 0.23 | 0.23 |
| ratio of horizontal width at ½ height of ridge to horizontal width of refrigerant passage | 0.19 | 0.19 | 0.19 | 0.33 | 0.33 | 0.33 |
| horizontal width per inter-ridge flat portion (mm) | 0.08 | 0.08 | 0.08 | 0.03 | 0.03 | 0.03 |
| ratio of horizontal width per inter-ridge flat portion to horizontal width of refrigerant passage | 0.11 | 0.11 | 0.11 | 0.04 | 0.04 | 0.04 |
| number of ridges of each refrigerant passage | 2 | 2 | 2 | 2 | 2 | 2 |
| passage area ($mm^2$) | 7.3 | 7.3 | 7.3 | 7.2 | 7.2 | 7.2 |
| wet edge length (mm) | 55.9 | 55.9 | 55.9 | 59.3 | 59.3 | 59.3 |

TABLE 2

| | Comparative example 1C | Comparative example 2C | Comparative example 3C | Comparative example 4 | Comparative example 5 |
|---|---|---|---|---|---|
| refrigerant passage shape | ridge on upper side | ridge on lower side | alternately on upper and lower | no ridge | ridge on upper and lower |
| number of refrigerant passages | 20 | 20 | 20 | 20 | 20 |
| vertical width of refrigerant passage (mm) | 0.77 | 0.77 | 0.77 | 0.77 | 0.77 |
| horizontal width of refrigerant passage (mm) | 0.68 | 0.68 | 0.68 | 0.68 | 0.68 |
| vertical width of refrigerant passage/thickness of flat multi-hole tube | 0.53 | 0.53 | 0.53 | 0.53 | 0.53 |
| height of ridge (mm) | 0.15 | 0.15 | 0.15 | — | 0.15 |
| horizontal width at ½ height of ridge (mm) | 0.04 | 0.04 | 0.04 | — | 0.13 |
| ratio of horizontal width at ½ height of ridge to horizontal width of refrigerant passage | 0.06 | 0.06 | 0.06 | — | 0.19 |
| horizontal width per inter-ridge flat portion (mm) | 0.16 | 0.16 | 0.16 | — | 0.08 |
| ratio of horizontal width per inter-ridge flat portion to horizontal width of refrigerant passage | 0.22 | 0.22 | 0.22 | — | 0.11 |
| number of ridges of each refrigerant passage | 2 | 2 | 2 | — | upper portion: 2 lower portion: 2 |
| passage area ($mm^2$) | 7.7 | 7.7 | 7.7 | 7.8 | 7.2 |
| wet edge length (mm) | 52.8 | 52.8 | 52.8 | 48.2 | 64.7 |

<Performance Evaluation>

The heat transfer performance of the extruded flat multi-hole tube manufactured as described above was measured under the conditions shown in Table 3. Refrigerant is supplied into a fluid passage of a flat multi-hole tube at a predetermined flow rate, and water is supplied in the direction opposite to the refrigerant flowing direction outside the flat multi-hole tube to perform heat exchange. Then, the heat transfer coefficient α and the pressure drop ΔP during evaporation and condensation of the refrigerant were measured. The results are shown in Tables 4 and 5. Note that the a/AP relative ratio is a relative ratio assuming that a/AP of comparative example 4 is "1".

TABLE 3

| | |
|---|---|
| evaporation | |
| refrigerant | R32 |
| refrigerant flow rate (kg/h) | 3, 4 |
| evaporation temperature (° C.) | 0 |
| temperature before expansion valve (° C.) | 30 |
| degree of superheat (° C.) | 2 |
| condensation | |
| refrigerant | R32 |
| refrigerant flow rate (kg/h) | 3, 5 |
| condensation temperature (° C.) | 40 |
| degree of superheat (° C.) | 20 |
| degree of supercooling (° C.) | 7 |

TABLE 4

| | | Example 1A | Example 2A | Example 3A |
|---|---|---|---|---|
| evaporation | refrigerant flow rate (kg/h) | 3 | 3 | 3 |
| | heat transfer coefficient α ($kW/m^2K$) | 13.59 | 12.32 | 13.21 |
| | pressure drop ΔP (kPa) | 11.14 | 12.53 | 11.56 |
| | α/ΔP | 1.22 | 0.98 | 1.15 |
| | α/ΔP relative ratio[1)] | 2.55 | 2.05 | 2.40 |
| condensation | refrigerant flow rate (kg/h) | 4 | 4 | 4 |
| | heat transfer coefficient α ($kW/m^2K$) | 24.99 | 17.24 | 22.67 |
| | pressure drop ΔP (kPa) | 17.54 | 25.21 | 19.84 |
| | α/ΔP | 1.42 | 0.68 | 1.20 |
| | α/ΔP relative ratio[1)] | 4.69 | 2.25 | 3.96 |
| | refrigerant flow rate (kg/h) | 3 | 3 | 3 |
| | heat transfer coefficient α ($kW/m^2K$) | 2.80 | 4.40 | 3.92 |
| | pressure drop ΔP (kPa) | 2.81 | 3.58 | 3.35 |
| | α/ΔP | 1.00 | 1.23 | 1.16 |
| | α/ΔP relative ratio[1)] | 1.26 | 1.56 | 1.47 |
| | refrigerant flow rate (kg/h) | 5 | 5 | 5 |
| | heat transfer coefficient α ($kW/m^2K$) | 6.04 | 6.43 | 6.31 |
| | pressure drop ΔP (kPa) | 5.45 | 5.73 | 5.65 |
| | α/ΔP | 1.11 | 1.12 | 1.12 |
| | α/ΔP relative ratio[1)] | 1.51 | 1.53 | 1.52 |

[1)]relative ratio assuming that α/ΔP of comparative example 4 is "1"

TABLE 5

| | | Comparative example 1B | Comparative example 2B | Comparative example 3B | Comparative example 1C | Comparative example 2C | Comparative example 3C | Comparative example 4 | Comparative example 5 |
|---|---|---|---|---|---|---|---|---|---|
| evaporation | refrigerant flow rate (kg/h) | 3 | 3 | 3 | 3 | 3 | 3 | 3 | 3 |
| | heat transfer coefficient α ($kW/m^2K$) | 12.21 | 11.58 | 12.03 | 11.14 | 10.10 | 10.72 | 5.86 | 16.55 |
| | pressure drop ΔP (kPa) | 12.81 | 13.78 | 13.10 | 10.81 | 12.15 | 11.34 | 12.23 | 16.73 |
| | α/ΔP | 0.95 | 0.84 | 0.92 | 1.03 | 0.83 | 0.95 | 0.48 | 0.99 |
| | α/ΔP relative ratio[1)] | 1.98 | 1.75 | 1.92 | 2.15 | 1.73 | 1.98 | 1.00 | 2.06 |
| | refrigerant flow rate (kg/h) | 4 | 4 | 4 | 4 | 4 | 4 | 4 | 4 |
| | heat transfer coefficient α ($kW/m^2K$) | 22.49 | 16.20 | 20.60 | 21.24 | 14.14 | 19.11 | 5.84 | 21.45 |
| | pressure drop ΔP (kPa) | 20.17 | 27.73 | 22.44 | 17.01 | 24.45 | 19.25 | 19.25 | 26.45 |
| | α/ΔP | 1.11 | 0.58 | 0.96 | 1.25 | 0.58 | 1.05 | 0.30 | 0.81 |
| | α/ΔP relative ratio[1)] | 3.72 | 1.95 | 3.19 | 4.16 | 1.92 | 3.49 | 1.00 | 2.67 |
| condensation | refrigerant flow rate (kg/h) | 3 | 3 | 3 | 3 | 3 | 3 | 3 | 3 |
| | heat transfer coefficient α ($kW/m^2K$) | 2.46 | 4.18 | 3.66 | 2.52 | 3.52 | 3.22 | 1.99 | 2.60 |
| | pressure drop ΔP (kPa) | 3.09 | 4.12 | 3.81 | 2.75 | 3.47 | 3.25 | 2.52 | 6.54 |
| | α/ΔP | 0.80 | 1.01 | 0.95 | 0.92 | 1.01 | 0.98 | 0.79 | 0.40 |
| | α/ΔP relative ratio[1)] | 1.01 | 1.28 | 1.20 | 1.16 | 1.28 | 1.24 | 1.00 | 0.50 |
| | refrigerant flow rate (kg/h) | 5 | 5 | 5 | 5 | 5 | 5 | 5 | 5 |
| | heat transfer coefficient α ($kW/m^2K$) | 5.73 | 6.11 | 6.00 | 5.44 | 5.59 | 5.54 | 5.92 | 5.58 |
| | pressure drop ΔP (kPa) | 6.00 | 6.59 | 6.41 | 5.34 | 5.56 | 5.49 | 8.06 | 12.50 |
| | α/ΔP | 0.96 | 0.93 | 0.94 | 1.02 | 1.00 | 1.01 | 0.73 | 0.45 |
| | α/ΔP relative ratio[1)] | 1.31 | 1.27 | 1.28 | 1.39 | 1.38 | 1.38 | 1.00 | 0.61 |

[1)]relative ratio assuming that α/ΔP of comparative example 4 is "1"

In examples 1A, 2A, and 3A of the present invention, even if the refrigerant flow rate varied, the relative ratio of the heat transfer coefficient α/pressure drop ΔP was 2 or more in the case of evaporation and 1.2 or more in the case of condensation assuming that the relative ratio in comparative example 4 is 1, which means that heat exchange performance against pressure drop was improved.

In contrast to these, in comparative examples 1B, 2B, and 3B having a large ratio of the horizontal width at ½ the height of the ridge with respect to the horizontal width of the refrigerant passage as well as comparative examples 1C, 2C, and 3C having a large ratio of the horizontal width per inter-ridge flat portion with respect to the horizontal width of the refrigerant passage, the relative ratio of the heat transfer coefficient α/pressure drop ΔP was not 2 or more in the case of evaporation and was not 1.2 or more in the case of condensation depending on the refrigerant flow rate, assuming that the relative ratio in comparative example 4 is 1.

REFERENCE SIGNS LIST

1*a*, 1*b*, 1*c* extruded aluminum flat multi-hole tube
2*a*, 2*b*, 21*c*, 22*c* refrigerant passage
3*a*, 3*b*, 31*c*, 32*c* upper wall surface
4*a*, 4*b*, 41*c*, 42*c* lower wall surface
5*a*, 5*b*, 51*c*, 52*c* one sidewall
6*a*, 6*b*, 61*c*, 62*c* the other sidewall
7*a*, 7*b*, 71*c*, 72*c* ridge
8*a*, 8*b*, 8*c* partition wall
9*a*, 9*b*, 9*c* upper outer wall
10*a*, 10*b*, 10*c* lower outer wall
11*a*, 11*b*, 11*c* outer sidewall
14 vertical width of refrigerant passage
15 height of ridge
16 wall surface position line of upper wall surface
17 tube length direction (extrusion direction)
18 tube width of extruded flat multi-hole tube
19 thickness of extruded flat multi-hole tube
20 horizontal width of refrigerant passage
25*a*, 25*b* header
26 refrigerant
28 inlet port
29 outlet port
30*a*, 30*b* heat exchanger
35, 45 heat dissipating fin
41 horizontal width of inter-ridge flat portion
42 horizontal width at ½ height of ridge
43 position at ½ height of ridge
444*a*, 44*b* end point of skirt portion of ridge
71 skirt portion of ridge
72 inter-ridge flat portion
73 top portion of ridge

The invention claimed is:

1. An extruded aluminum flat multi-hole tube, comprising:

a plurality of refrigerant passages extending in a tube length direction, each one of the plurality of refrigerant passages including an upper wall surface and a lower wall surface opposed to each other and a pair of opposed sidewall surfaces, and a plurality of ridges extending in the tube length direction formed only on the upper wall surface of the refrigerant passage, wherein a height of a ridge of the plurality of ridges is 5 to 25% of a vertical width of the refrigerant passage, wherein a ratio of a horizontal width of a ridge of the plurality of ridges at ½ the height of the ridge with respect to a horizontal width of the refrigerant passage is 0.05 to 0.30, wherein a ratio of a horizontal width per inter-ridge flat portion of the upper wall surface with respect to the horizontal width of the refrigerant passage is 0.20 or less, wherein the extruded aluminum flat multi-hole tube is a flat multi-hole tube made of aluminum or aluminum alloy and manufactured by extrusion molding, and wherein the horizontal width of the refrigerant passage is 0.45 mm to 2 mm.

2. The extruded aluminum flat multi-hole tube according to claim 1, wherein a top portion of a ridge of the plurality of ridges has an arcuate or circular arcuate shape.

3. The extruded aluminum flat multi-hole tube according to claim 1, wherein the number of the ridges formed on the upper wall surface of each of the refrigerant passages is 2 to 4.

4. An extruded aluminum flat multi-hole tube, comprising:

a plurality of refrigerant passages extending in a tube length direction, each one of the plurality of refrigerant passages including an upper wall surface and a lower wall surface opposed to each other and a pair of opposed sidewall surfaces, and a plurality of ridges extending in the tube length direction formed only on the lower wall surface of the refrigerant passage, wherein a height of a ridge of the plurality of ridges is 5 to 25% of a vertical width of the refrigerant passage, wherein a ratio of a horizontal width of a ridge of the plurality of ridges at ½ the height of the ridge with respect to a horizontal width of the refrigerant passage is 0.05 to 0.30, wherein a ratio of a horizontal width per inter-ridge flat portion on the lower wall surface with respect to the horizontal width of the refrigerant passage is 0.20 or less, wherein the extruded aluminum flat multi-hole tub is a flat multi-hole tube made of aluminum or aluminum alloy and manufactured by extrusion molding, and wherein the horizontal width of the refrigerant passage is 0.45 mm to 2 mm.

5. The extruded aluminum flat multi-hole tube according to claim 4, wherein a top portion of a ridge of the plurality of ridges has an arcuate or circular arcuate shape.

6. The extruded aluminum flat multi-hole tube according to claim 4, wherein the number of the ridges formed on the lower wall surface of each of the refrigerant passages is 2 to 4.

7. An extruded aluminum flat multi-hole tube, comprising:

a plurality of refrigerant passages extending in a tube length direction, each one of the plurality of refrigerant passages including an upper wall surface and a lower wall surface opposed to each other and a pair of opposed sidewall surfaces, wherein the plurality of the refrigerant passages is a combination of an upper wall surface ridge forming refrigerant passage where a plurality of ridges extending in the tube length direction is formed only on the upper wall surface and a lower wall surface ridge forming refrigerant passage where a second plurality of ridges extending in the tube length direction is formed only on the lower wall surface, wherein a height of any of the plurality of ridges is 5 to 25% of a vertical width of the refrigerant passage, wherein a ratio of a horizontal width of any of the plurality of ridges at ½ the height of the ridge with respect to a horizontal width of the refrigerant passage is 0.05 to 0.30, wherein a ratio of a horizontal width per inter-ridge flat portion of the upper wall surface with respect to the horizontal width of the refrigerant passage is 0.20 or less, wherein a ratio of a horizontal width per inter-ridge flat portion of the lower wall surface with respect to the horizontal width of the refrigerant passage is 0.20 or less, wherein the extruded aluminum flat multi-hole tube is a flat multi-hole tube made of aluminum or aluminum alloy and manufactured by extrusion molding, and wherein the horizontal width of the refrigerant passage is 0.45 mm to 2 mm.

8. The extruded aluminum flat multi-hole tube according to claim 7, wherein a top portion of any of the ridges has an arcuate or circular arcuate shape.

9. The extruded aluminum flat multi-hole tube according to claim 7, wherein the ratio of the number of the upper wall surface ridge forming refrigerant passages and the number of the lower wall surface ridge forming refrigerant passages is 2:8 to 8:2.

10. The extruded aluminum flat multi-hole tube according to claim 7, wherein the upper wall surface ridge forming refrigerant passages and the lower wall surface ridge forming refrigerant passages are alternately repeated.

11. The extruded aluminum flat multi-hole tube according to claim 7, wherein the number of the ridges formed on the upper wall surface or the lower wall surface of each of the refrigerant passages is 2 to 4.

12. A heat exchanger, comprising:

a plurality of flat multi-hole tubes arranged in rows and a plurality of heat dissipating fins fixed to the flat multi-hole tubes, wherein the flat multi-hole tubes are the extruded aluminum flat multi-hole tubes according to claim 1.

13. A heat exchanger, comprising:

a plurality of flat multi-hole tubes arranged in rows and a plurality of heat dissipating fins fixed to the flat multi-hole tubes, wherein the flat multi-hole tubes are the extruded aluminum flat multi-hole tubes according to claim 4.

14. A heat exchanger, comprising:

first extruded aluminum flat multi-hole tubes according to claim 1, second extruded aluminum flat multi-hole tubes comprising:

a plurality of refrigerant passages extending in a tube length direction, each one of the plurality of refrigerant passages including an upper wall surface and a lower wall surface opposed to each other and a pair of opposed sidewall surfaces; and a plurality of ridges extending in the tube length direction formed only on the lower wall surface of the refrigerant passage;

wherein a height of a ridge of the plurality of ridges is 5 to 25% of a vertical width of the refrigerant passage;

wherein a ratio of a horizontal width of a ridge of the plurality of ridges at ½ the height of the ridge with respect to a horizontal width of the refrigerant passage is 0.05 to 0.30, and wherein a ratio of a horizontal width per inter-ridge flat portion on the lower wall surface with respect to the horizontal width of the refrigerant passage is 0.20 or less, and a plurality of heat dissipating fins fixed to the first extruded aluminum flat multi-hole tubes and the second extruded aluminum multi-hole tubes, wherein the first extruded aluminum flat multi-hole tubes are disposed on a gas phase side, and the second extruded aluminum flat multi-hole tubes are disposed on a liquid phase side, wherein the horizontal width of the refrigerant passage is 0.45 mm to 2 mm.

15. A heat exchanger, comprising:

a plurality of flat multi-hole tubes arranged in rows and a plurality of heat dissipating fins fixed to the flat multi-hole tubes, wherein the flat multi-hole tubes are the extruded aluminum flat multi-hole tubes according to claim 7.

* * * * *